US008985720B2

(12) United States Patent
Nakano et al.

(10) Patent No.: US 8,985,720 B2
(45) Date of Patent: Mar. 24, 2015

(54) RECORDING APPARATUS

(71) Applicant: Seiko Epson Corporation, Tokyo (JP)

(72) Inventors: Yosuke Nakano, Shiojiri (JP); Satoshi Shimizu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/962,577

(22) Filed: Aug. 8, 2013

(65) Prior Publication Data

US 2014/0043384 A1 Feb. 13, 2014

(30) Foreign Application Priority Data

Aug. 10, 2012 (JP) ..... 2012-178505

(51) Int. Cl.

| | |
|---|---|
| ***B41J 29/38*** | (2006.01) |
| ***B41J 2/175*** | (2006.01) |
| ***B41J 2/07*** | (2006.01) |
| ***B41J 13/10*** | (2006.01) |
| ***B41J 29/02*** | (2006.01) |

(52) U.S. Cl.

CPC *B41J 2/07* (2013.01); *B41J 13/103* (2013.01); *B41J 13/106* (2013.01); *B41J 29/02* (2013.01)

USPC ..... 347/9; 347/85

(58) Field of Classification Search

CPC ..... B41J 29/02; B41J 29/13; B41J 2/17553; B41J 15/044; B41J 2/175; B41J 2/17596

USPC ..... 347/2, 3, 9, 108, 84, 85

See application file for complete search history.

(56) References Cited

U.S. PATENT DOCUMENTS

| | | | | |
|---|---|---|---|---|
| 5,909,226 | A * | 6/1999 | Takeda | 347/3 |
| 8,016,412 | B2 * | 9/2011 | Kawai et al. | 347/108 |
| 8,233,018 | B2 * | 7/2012 | Sato et al. | 347/170 |

FOREIGN PATENT DOCUMENTS

| | | |
|---|---|---|
| JP | 2010-131893 | 6/2010 |
| JP | 2012-107393 | 6/2012 |

* cited by examiner

*Primary Examiner* — An Do

(74) *Attorney, Agent, or Firm* — Workman Nydegger

(57) ABSTRACT

A printer includes a recording unit and a scanner unit configured to open and close the top portion of the recording unit. The recording unit includes a flexible ink tube through which ink from an ink tank is supplied to the head unit, and a control unit that controls the head unit, according to a state of a press-down switch provided on the top portion of the recording unit, so as to perform recording on a medium when a pressed state of the switch is detected and not to perform the recording when an unpressed state of the switch is detected. The switch enters the pressed state when a gap that allows the ink tube to pass therethrough is formed between the recording unit and the scanner unit, the gap having a size that at least prevents an ink flow path in the ink tube from being blocked.

35 Claims, 11 Drawing Sheets

RECORDING APPARATUS

BACKGROUND

1. Technical Field

The present invention relates to a recording apparatus including a recording unit and an upper structure provided on top of the recording unit so as to open and close the top portion of the recording unit.

2. Related Art

Recording apparatuses integrally constituted of a recording unit and an upper structure such as a scanner unit, so called multifunction printer, have come to be widely employed, among which ink jet multifunction printers are most popular (see, for example, JP-A-2012-107393). Many of the ink jet multifunction printers are serial ink jet printers including a head unit (also called a carriage) with a recording head that ejects ink, the head unit being set to move in a predetermined direction.

Some of the head units include an ink chamber (hereinafter also referred to as "ink cartridge") in which the ink is stored, while others do not include the ink cartridge.

The head unit including the ink cartridge is set to reciprocate in a predetermined direction with the ink cartridge mounted thereon, and the ink is supplied inside the head unit, from the ink cartridge to the recording head. In the printers in which the head unit is without the ink cartridge, the ink cartridge is provided independent from the head unit, and the ink cartridge and the head unit (recording head) are connected via an ink tube for supplying the ink therethrough (see, for example, JP-A-2010-131893).

Recently there has been an increasing demand for reduction in size of the ink jet multifunction printer, especially in height, i.e., reduction in size of the apparatus in the height direction. With the ink jet printer in which the ink cartridge is not mounted on the head unit, however, the ink tube has to be arranged between the inside and outside of the apparatus, which leads to an increase in size of the apparatus in the height direction. In addition, the ink tube has to be arranged between the inside and outside of the apparatus so as not to compromise the recording performance of the apparatus.

SUMMARY

An advantage of some aspects of the invention is that a recording apparatus integrally constituted of a recording unit and an upper structure is provided, in which an ink tube is provided so as to suppress an increase in height of the apparatus without compromising the recording performance.

In an aspect, the invention provides a recording apparatus including a recording unit including a head unit having a recording head that ejects ink onto a medium, the head unit being mounted inside the apparatus main body so as to move in a scanning direction of the recording head, and an upper structure provided on top of the recording unit so as to open and close the top portion of the recording unit. The recording unit includes a flexible ink tube through which the ink from an ink chamber is supplied to the head unit, a control unit that controls the head unit, according to a state of a press-down switch provided on the top portion of the recording unit, so as to perform recording on the medium when a pressed state of the switch is detected and not to perform the recording when an unpressed state of the switch is detected, a feed unit that delivers the medium from a medium storage unit in which the medium is stored, and a medium receiving tray that receives the medium discharged and that can be displaced between a projecting position in which the medium receiving tray sticks out from the recording unit and a retracted position in which the medium receiving tray is accommodated inside the recording unit. The medium storage unit includes a medium storage tray located under the medium receiving tray and configured to be removably mounted in the recording unit independent from the medium receiving tray. The medium receiving tray includes a cutout formed on an upstream side in a discharge direction of the medium so as to avoid interference with the feed unit so that the feed unit is located inside the cutout when the medium receiving tray is at the retracted position, and the switch enters the pressed state when a gap that allows the ink tube to pass therethrough is formed between the recording unit and the upper structure, the gap having a size that at least prevents an ink flow path in the ink tube from being blocked.

With the foregoing recording apparatus, including the recording unit and the upper structure configured so as to open and close the top portion of the recording unit, the recording operation can be performed with a gap formed between the recording unit and the upper structure, the gap having a size that at least prevents the ink flow path in the ink tube from being blocked, in other words with a gap of a minimum necessary size. Such a configuration suppresses an increase in height of the apparatus despite the ink tube being passed through between the recording unit and the upper structure, without compromising the recording performance.

In addition, the medium receiving tray that receives the discharged medium includes the cutout for avoiding interference with the feed unit. Such a configuration eliminates the need to superpose the feed unit on the medium receiving tray in the height direction of the apparatus, and allows the feed unit and the medium receiving tray to overlap in the height direction, thereby further contributing to reducing the size of the apparatus in the height direction.

In the foregoing recording apparatus, the feed unit and the cutout may overlap in a height direction when the medium receiving tray is at the retracted position.

In the foregoing recording apparatus, a reference feed position of the feed unit may be located at a position corresponding to the center of the medium in a width direction, and the cutout may be formed at a central position of the medium receiving tray in the width direction of the medium.

In the foregoing recording apparatus, the cutout portion may be formed so as to become narrower toward a downstream side in a direction in which the medium is discharged.

In the foregoing recording apparatus, the medium receiving tray may include a guide member that supports a disk tray.

In the foregoing recording apparatus, the medium storage unit includes a plurality of the medium storage trays including a lower tray and an upper tray located above the lower tray independent therefrom, and one of the upper tray and the lower tray may be accessible by the feed unit when the other is removed from the recording unit.

In this case, since the feed unit can make access to one of the lower tray and the upper tray when the other is removed from the recording unit, the feed unit can deliver the medium irrespective of the mounting status of the medium storage trays.

In the foregoing recording apparatus, the feed unit may include a single feed roller, and both the upper tray and the lower tray may be accessible by the single feed roller.

The mentioned configuration allows a single feed roller to make access to both the upper tray and the lower tray, and thus allows the feed unit to be simplified and contributes to reducing the cost.

In the foregoing recording apparatus, the upper structure may be a scanner unit.

In the foregoing recording apparatus, the scanner unit may include a protruding portion bulging from a bottom face of the scanner unit and including a guide member configured to guide in the scanning direction a reading unit that makes a scanning motion in the stroke direction of the head unit, and the ink tube may be connected to both the head unit and the ink chamber without intersecting the protruding portion in a depth direction of the recording unit.

In this case, the scanner unit includes, because of a design requirement, the protruding portion bulging from the bottom face, and the ink tube is connected to the head unit and the ink chamber without intersecting the protruding portion. Such a configuration suppresses an increase in size of the apparatus in the height direction.

In the foregoing recording apparatus, the gap may be defined by a gap forming member provided on an upper face of the recording unit.

In this case, the gap forming member is provided on the upper face of the recording unit to form the gap. Such a configuration assures that the gap is securely formed.

In the foregoing recording apparatus, the recording unit may include a housing having an opening in which an upper portion of at least a part of a stroke region of the head unit is exposed, and the ink tube may be fixed to an upper face of the housing at a position close to the opening.

With the mentioned configuration, since the ink tube is fixed to the upper face of the housing at a position close to the opening, the housing can be utilized as a fastener of the ink tube, and therefore the space and the cost for fixing the ink tube can be saved.

In the foregoing recording apparatus, the switch may be located in a bore formed in the upper face of the recording unit, and the upper structure may include a projection formed on a lower face so as to press down the switch upon intruding in the bore and form the gap while keeping the switch pressed.

In this case, when the upper structure is open the projection is disengaged from the switch and the switch is released from the pressed state. The mentioned configuration allows, therefore, the control unit of the recording apparatus to inhibit the recording operation while the upper structure is open.

In the foregoing recording apparatus, at least one of a plurality of the ink chambers may be provided outside of the apparatus main body.

In the foregoing recording apparatus, the ink chamber provided outside of the apparatus main body may be located on a side face of the recording unit.

In another aspect, the invention provides a recording apparatus including a recording unit including a head unit having a recording head that ejects ink onto a medium, the head unit being configured to move in a scanning direction of the recording head, and a scanner unit provided on top of the recording unit so as to open and close the top portion of the recording unit. The recording unit includes a flexible ink tube through which the ink from an ink chamber is supplied to the head unit, and a control unit that controls the head unit, according to a state of a press-down switch provided on the top portion of the recording unit, so as to perform recording on the medium when a pressed state of the switch is detected and not to perform the recording when an unpressed state of the switch is detected, and the switch enters the pressed state when a gap that allows the ink tube to pass therethrough is formed between the recording unit and the scanner unit, the gap having a size that at least prevents an ink flow path in the ink tube from being blocked.

With the foregoing recording apparatus, including the recording unit and the scanner unit configured so as to open and close the top portion of the recording unit, the recording operation can be performed with a gap formed between the recording unit and the scanner unit, the gap having a size that at least prevents the ink flow path in the ink tube from being blocked, in other words with a gap of a minimum necessary size. Such a configuration suppresses an increase in height of the apparatus despite the ink tube being passed through between the recording unit and the scanner unit, without compromising the recording performance.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereafter, an embodiment of the invention will be described with reference to the drawings. It is to be understood that the invention may be modified from the following embodiment in various manners within the scope of the appended claims, and that such modifications are duly included in the invention.

Figure 1:
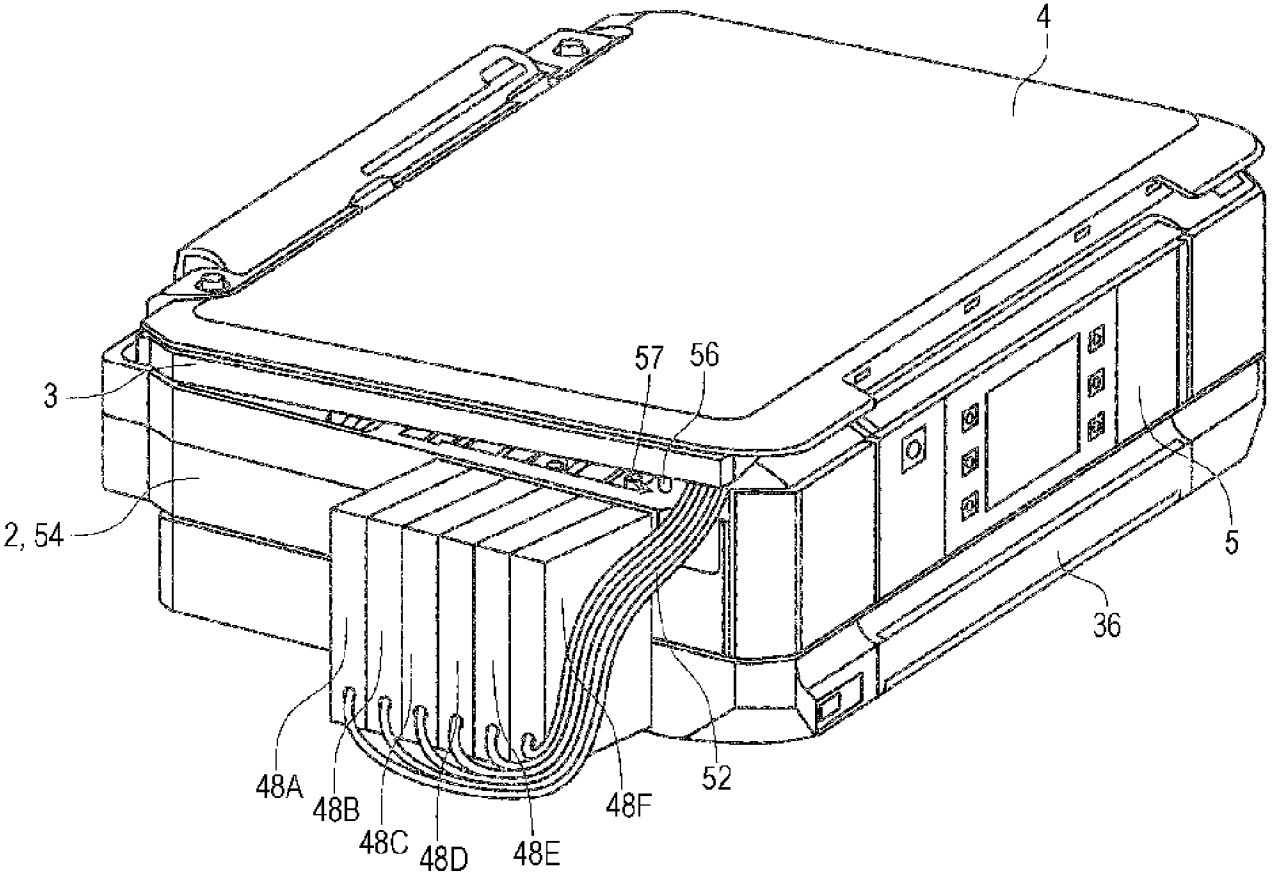
FIG. 1 is a perspective view showing an appearance of a printer according to an embodiment of the invention, with a scanner unit set to a closed position.
Figure 2:
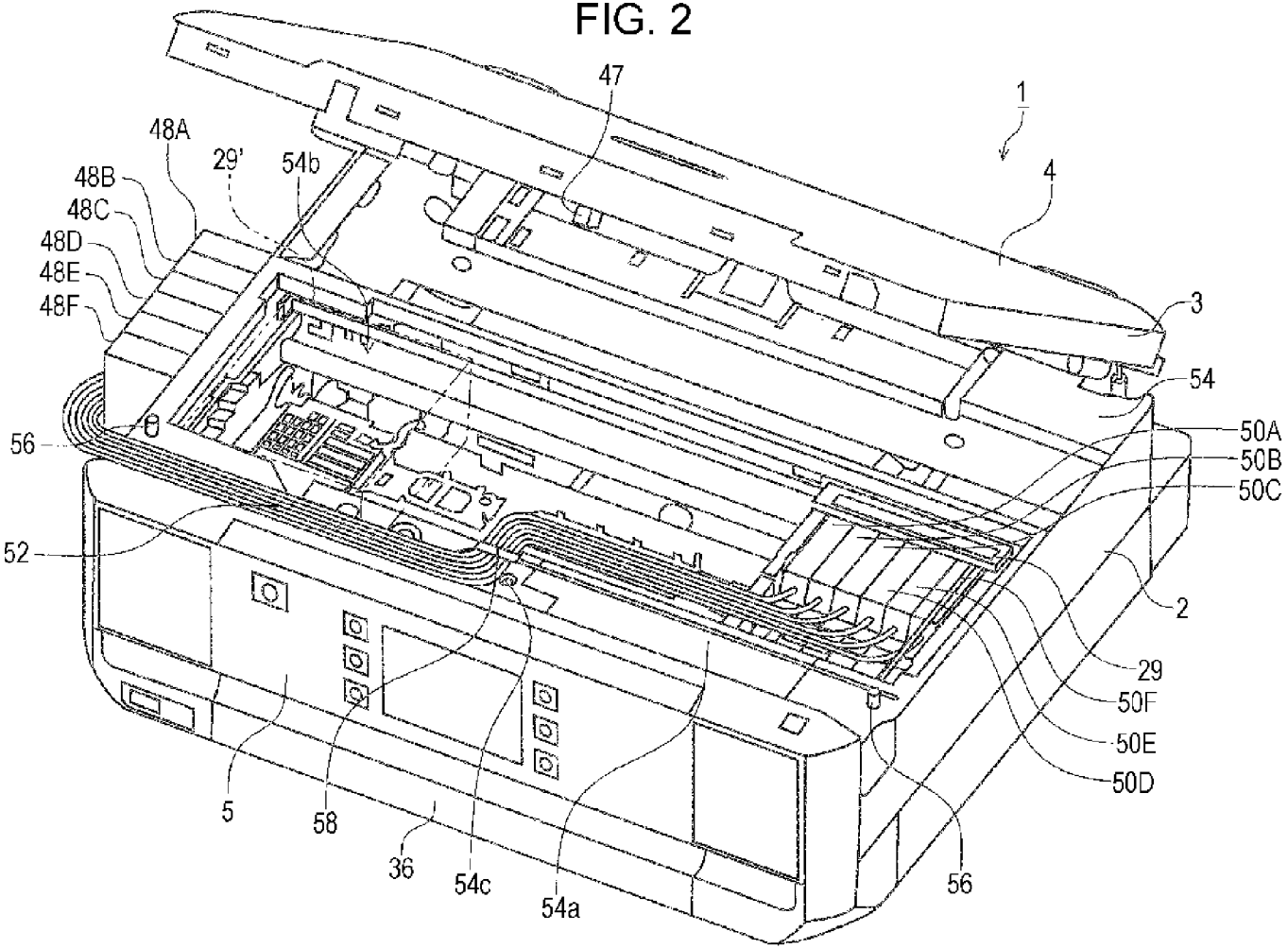
FIG. 2 is a perspective view showing an appearance of the printer according to the embodiment, with the scanner unit set to the open position.
Figure 3:
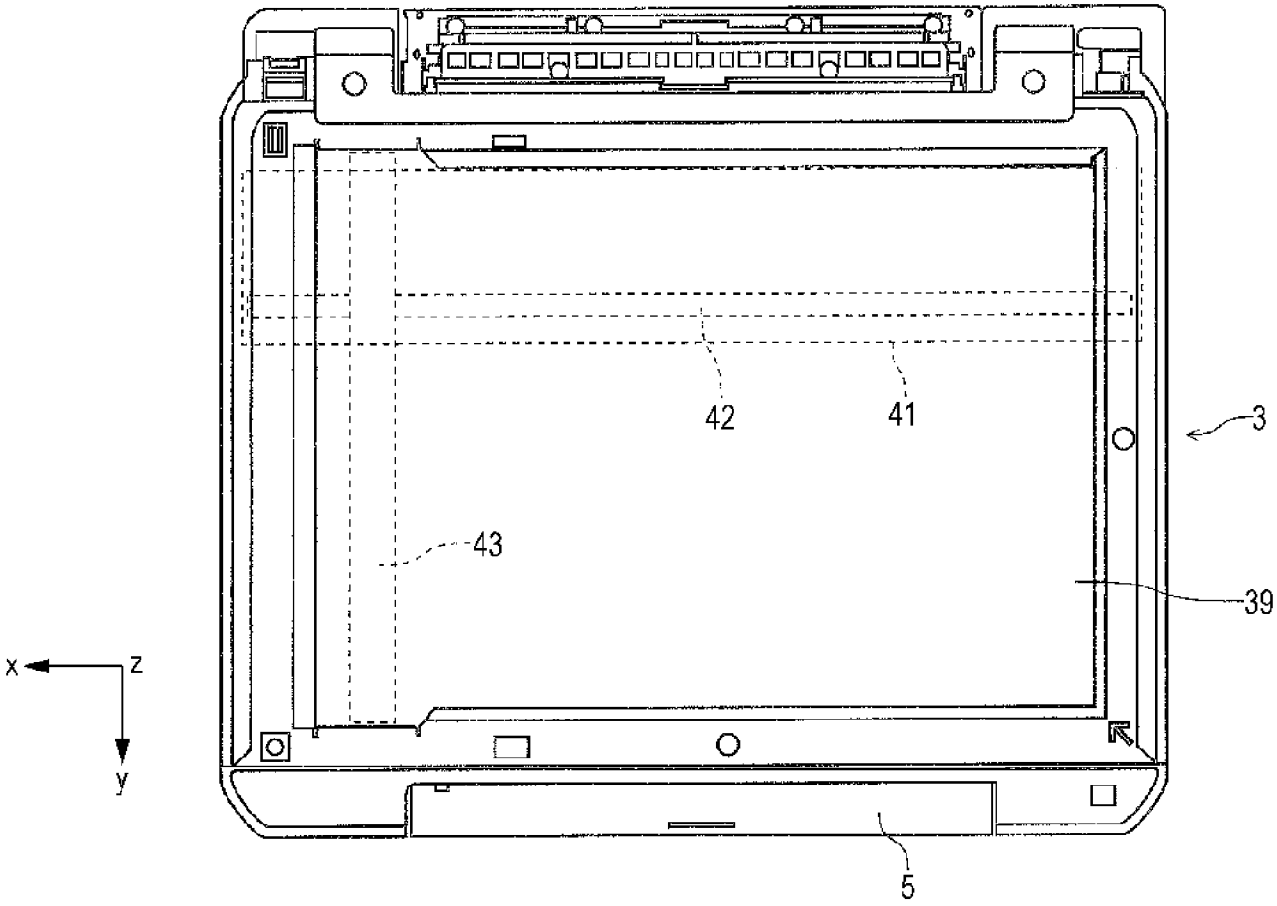
FIG. 3 is a plan view showing the scanner unit (source document table).
Figure 4:
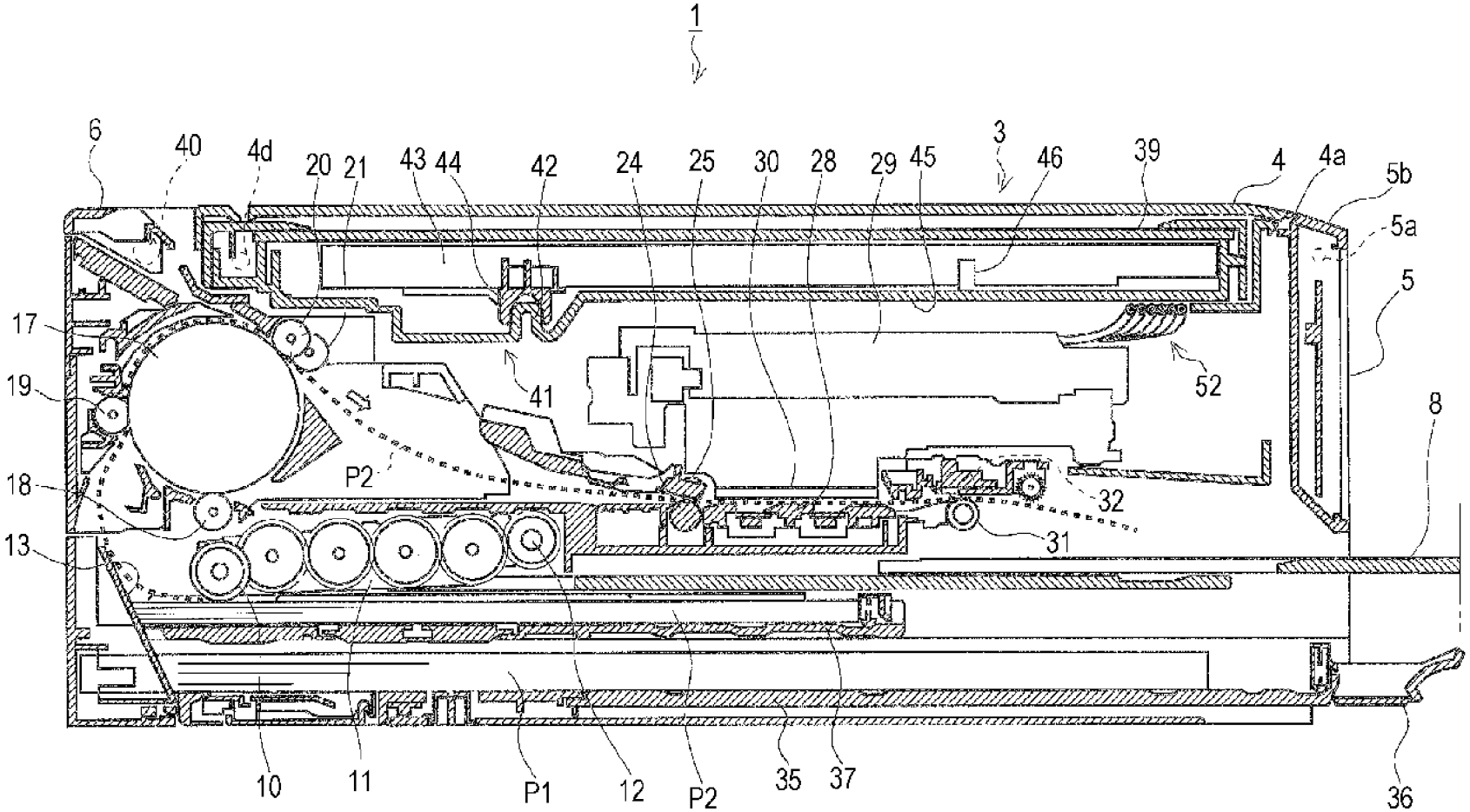
FIG. 4 is a cross-sectional view showing a sheet transport route in the printer according to the embodiment.

FIGS. 1 and 2 are perspective views showing appearances of an ink jet printer (hereinafter, simply "printer") 1 according to the embodiment, exemplifying the recording apparatus according to the invention. FIG. 1 illustrates a state in which a scanner unit 3 is closed and FIG. 2 illustrates a state in which the scanner unit 3 is open. FIG. 3 is a plan view of the scanner unit 3 (source document table 39), and FIG. 4 is a cross-sectional view showing a sheet transport route in the printer 1.

Figure 5:
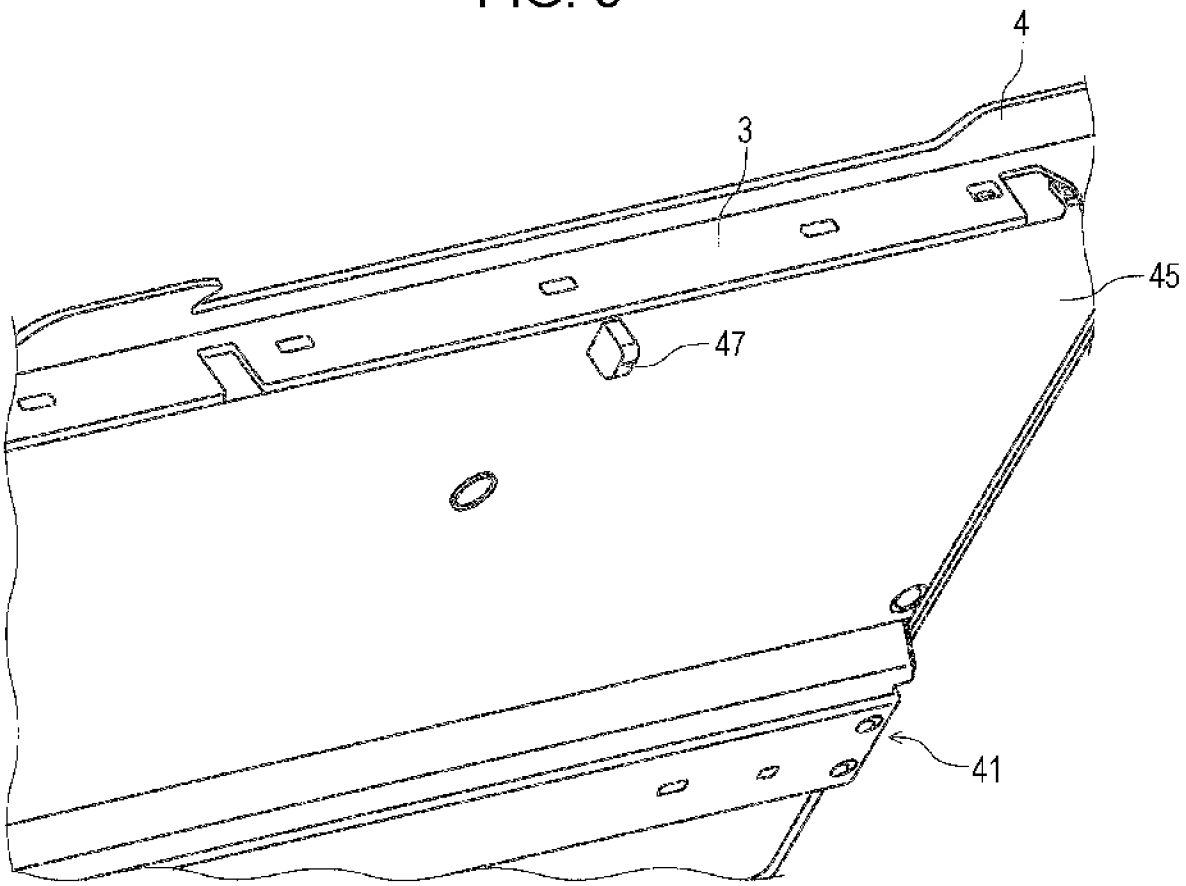
FIG. 5 is an enlarged fragmentary perspective view of the bottom face of the scanner unit.
Figure 8:
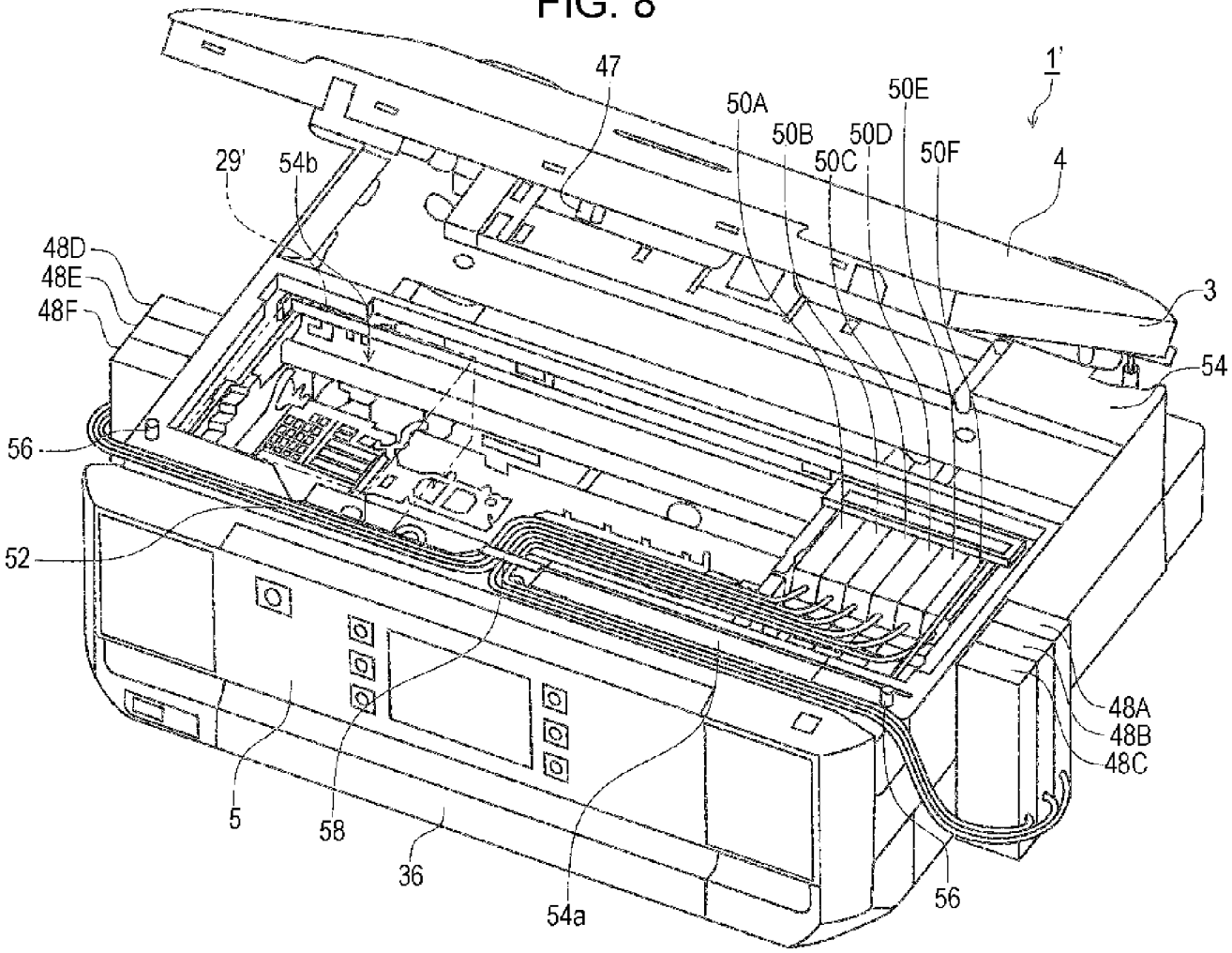
FIG. 8 is a perspective view showing an appearance of a printer according to a variation of the embodiment, with the scanner unit set to the open position.
Figure 9:
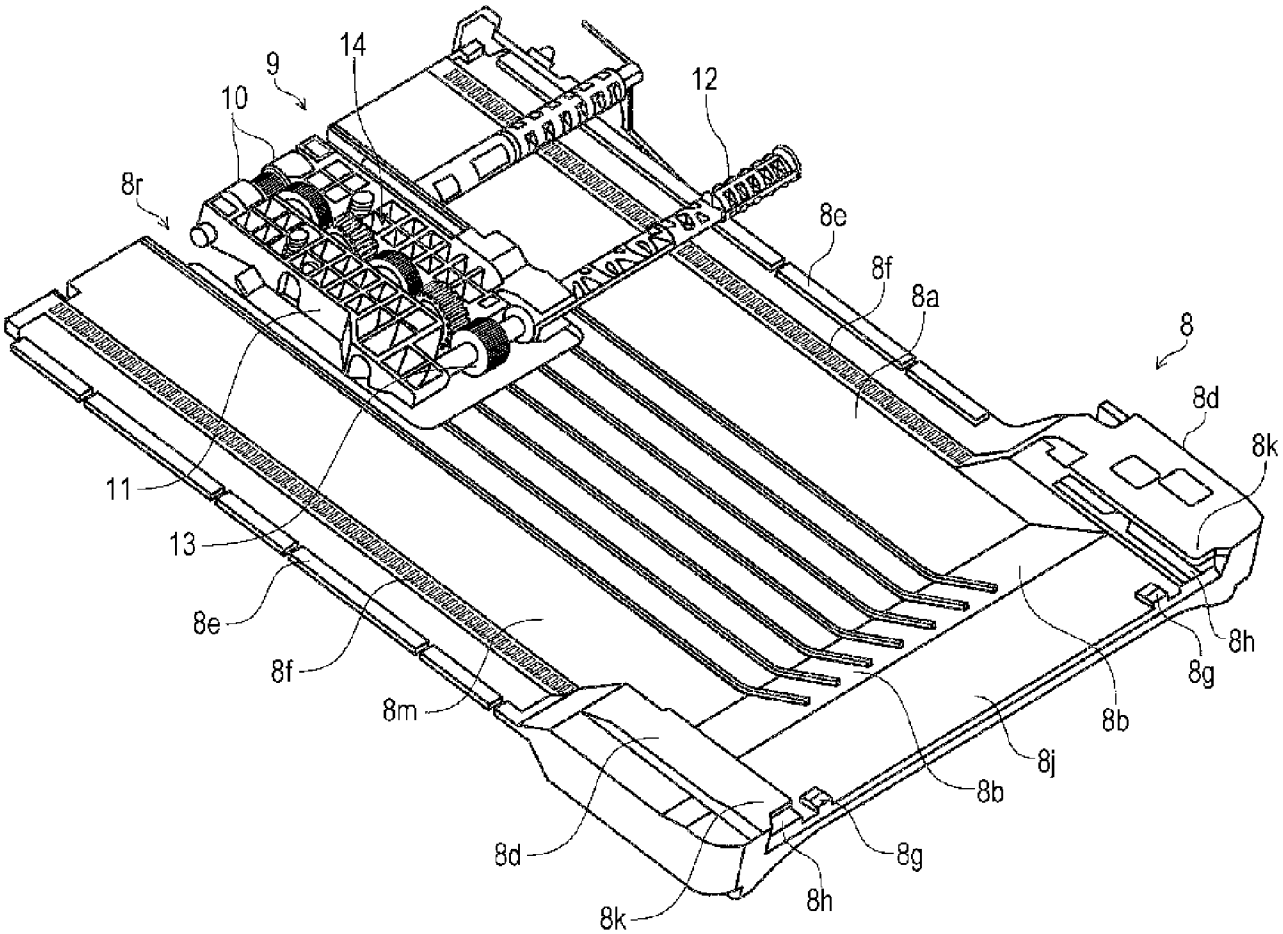
FIG. 9 is a perspective view showing a positional relationship between a feed unit and a discharged sheet tray.
Figure 10:
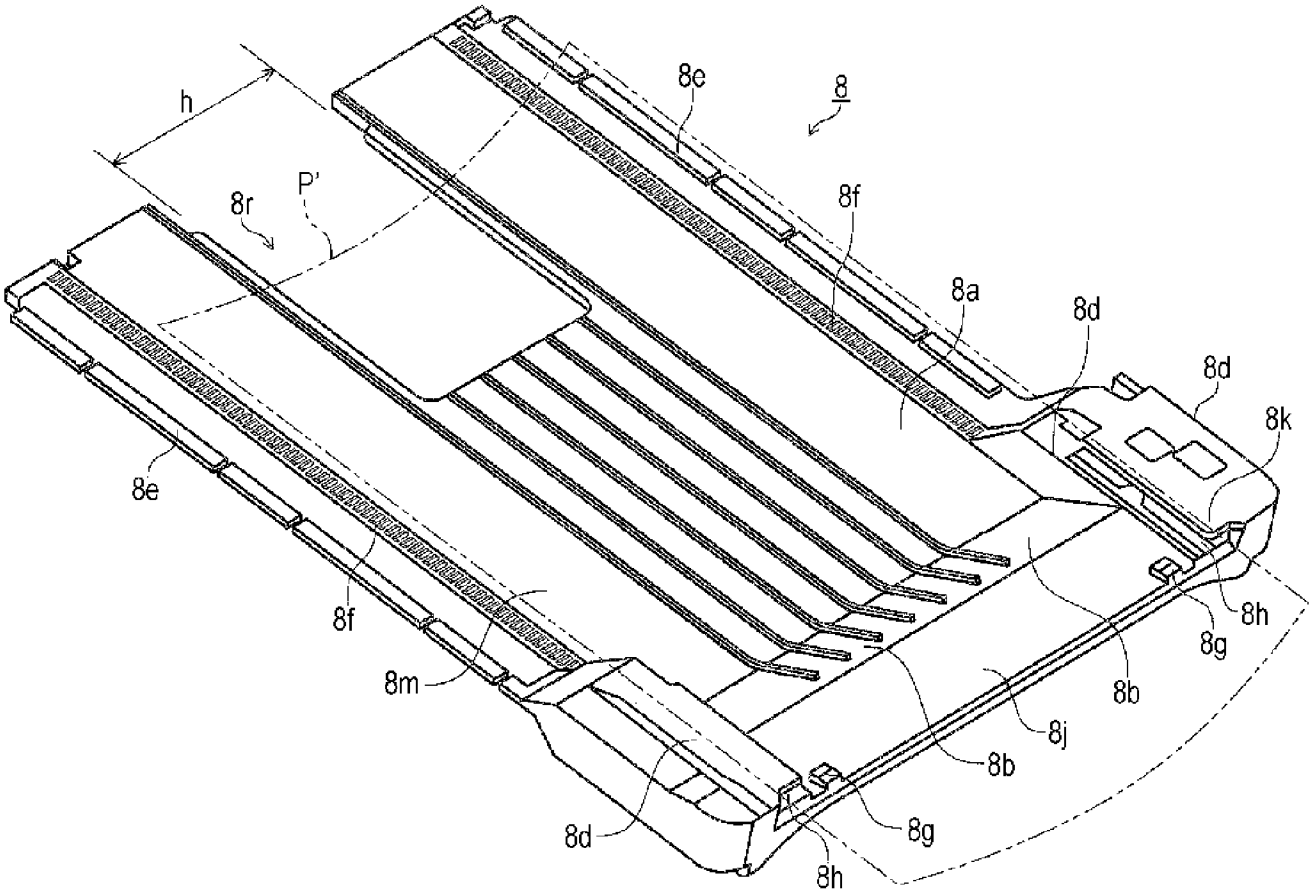
FIG. 10 is a perspective view showing the discharged sheet tray.
Figure 11A:
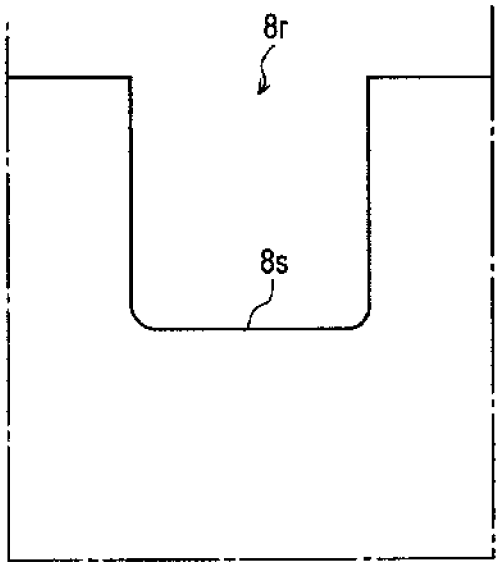
FIGS. 11A and 11B are schematic plan views showing shapes of a cutout formed in the discharged sheet tray.
Figure 11B:
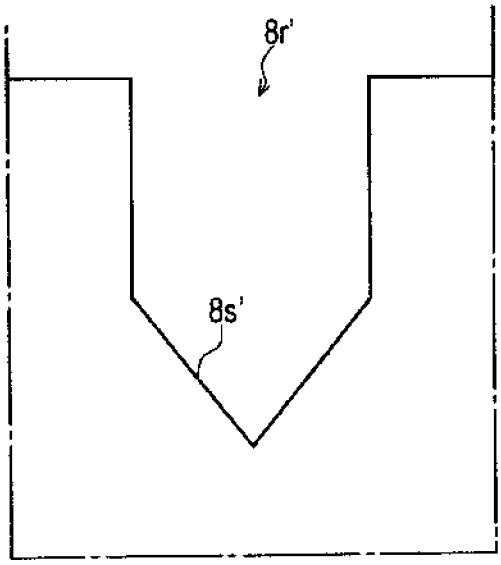

FIG. 5 is an enlarged fragmentary perspective view of the bottom face of the scanner unit 3. FIGS. 6A, 6B, 7A, and 7B are front views of a switch 60 provided on a top portion of a recording unit. FIG. 8 is a perspective view showing an appearance of a printer 1' according to a variation of the embodiment. FIG. 9 is a perspective view showing a positional relationship between a feed unit 9 and a discharged sheet tray 8. FIG. 10 is a perspective view of the discharged sheet tray 8. Further, FIGS. 11A and 11B are schematic plan views showing shapes of a cutout portion (an escape portion) formed in the discharged sheet tray 8.

First, a general configuration of the printer 1 will be described. The printer 1 includes a recording unit 2 that performs ink jet printing on a recording sheet, an example of the medium in the invention, and the scanner unit 3, an example of the upper structure in the invention, pivotably attached to the top portion of the recording unit 2. Thus, the printer 1 is constituted as an ink jet multifunction printer having both the ink jet printing function and the scanning function.

The scanner unit 3 is pivotably connected to the recording unit 2 about a pivotal shaft 40 (see FIG. 4), so as to assume the closed state (FIG. 1) and the open state (FIG. 2) upon being made to pivot.

The scanner unit 3 includes an openable top cover 4, and the source document table 39 (see FIGS. 3 and 4) of the scanner unit 3 is exposed upon opening the top cover 4. Hereinafter, the closed state of the scanner unit 3 will refer to a state in which a gap 57 (subsequently described in details) is formed between the recording unit 2 and the scanner unit 3, and the scanner unit 3 is unable to be brought any closer to the recording unit 2.

The printer 1 includes an operation panel 5 located on the front face and including operating buttons such as a power button, a setting button, and an instruction button, and a display unit that displays conditions set for printing, a preview of the image to be printed, and so forth. The operation panel 5 is tiltable to an angle that facilitates the user to manipulate the operation panel 5. Here, the tilting angle of the operation panel 5 is maintained by an angle retention mechanism (not shown), so as to withstand an external force exerted thereon for manipulating the buttons.

A reference numeral 36 on the front face of the printer 1 indicates an openable lid 36 provided on a lower tray 35. FIGS. 1 and 2 illustrate a state in which the lid 36 is closed, and FIG. 4 illustrates a state in which the lid 36 is open. When the lid 36 is open the lower tray 35, an upper tray 37, and a discharged sheet tray 8 are exposed, so that the lower tray 35 or the upper tray 37 can be removed or mounted in the printer 1.

The discharged sheet tray 8 is configured to slide, driven by a non-illustrated motor, between a retracted position of being accommodated inside the recording unit 2 as shown in FIGS. 1 and 2, and a projecting position of sticking forward from the recording unit 2 as shown in FIG. 4. The discharged sheet tray 8 becomes capable of receiving the recording sheet that has undergone the recording operation and been discharged, when assuming the projecting position. Here, although the discharged sheet tray 8 according to this embodiment is configured to be displaced by a motor (automatic opening type), the discharged sheet tray may be of a manual opening type to be displaced by the user.

The lower tray 35 and the upper tray 37 superposed thereon are configured to accommodate a plurality of recording sheets, and removably mounted in the recording unit 2. The lower tray 35 includes the lid 36 pivotably attached thereto. Here, the lower tray 35 and the upper tray 37 are removably mounted in the recording unit 2 independent from each other, as well as from the discharged sheet tray 8.

Hereunder, a transport route of the recording sheet in the printer 1 will be described, focusing on FIG. 4. The printer 1 according to this embodiment includes the lower tray 35 and the upper tray 37, located in the bottom portion of the apparatus and constituting the medium storage unit in the invention. The recording sheets are delivered one by one from the lower tray 35 or the upper tray 37.

The upper tray 37 is configured to slide between a feed position (FIG. 4) and a stand-by position (not shown), driven by a non-illustrated motor.

In FIG. 4, the recording sheet placed in the lower tray 35 is denoted by a code P1 and the recording sheet placed in the upper tray 37 is denoted by a code P2. However, hereinafter the recording sheet may be simply denoted by P, when it is not necessary to distinguish between the recording sheets P1 and P2.

A feed roller (also called a pickup roller) 10 driven by a non-illustrated motor is attached to a swinging member 11 configured to swing about a pivotal shaft 12. When the upper tray 37 is at the stand-by position (not shown), i.e., the forwardmost position in the apparatus (on the right in FIG. 4 which is the removal direction of the upper tray 37, the feed roller 10 contacts, while rotating, the uppermost one of the recording sheets P1 placed in the lower tray 35, to thereby deliver the uppermost recording sheet P1 from the lower tray 35.

In contrast, when the upper tray 37 is at the feed position, i.e., at the rearmost position in the apparatus (on the left in FIG. 4, which is the insertion direction of the upper tray 37 and also the feeding direction of the recording sheet), the feed roller 10 contacts, while rotating, the uppermost one of the recording sheets P2 placed in the upper tray 37, to thereby deliver the uppermost recording sheet P2 from the upper tray 37. Broken lines in FIG. 4 indicate the locus of the recording sheet P2 delivered from the upper tray 37.

In this embodiment, both the lower tray 35 and the upper tray 37 can be accessed by a single feed roller 10. In addition, when one of the lower tray 35 and the upper tray 37 is removed from the recording unit 2, the feed roller 10 can make access to the other to deliver the recording sheet from the other tray.

A splitting slope 13 is provided at a position opposing the end portion of the lower tray 35 and the upper tray 37. The recording sheets P delivered from the lower tray 35 or the upper tray 37 proceed to the downstream side with the leading edge disposed in contact with the splitting slope 13, so that the uppermost one of the recording sheets P is split from the second and the subsequent recording sheets P.

A reverse roller 17 driven by a non-illustrated motor is provided ahead of the splitting slope 13, and the recording sheet P is curved and reversed by the reverse roller 17 to proceed toward the frontal region of the apparatus. Here, numerals 18, 19, 20, and 21 each indicate a free-rotating slave roller, and the recording sheet P delivered from either tray is nipped between the slave roller 19 and the reverse roller 17, or between the slave roller 20 and the reverse roller 17, thus to be transported to the downstream side.

A transport drive roller 24 driven by a non-illustrated motor and a transport slave roller 25 that follows the rotation of the transport drive roller 24 in contact therewith are provided ahead of the reverse roller 17, so that the recording sheet P is transported by these rollers to the position under a recording head 30.

The recording head 30 that ejects the ink is located on the bottom portion of a head unit 29. The head unit 29 is driven by a non-illustrated motor so as to reciprocate in the scanning direction of the recording head (depth direction in FIG. 4).

A platen 28 is disposed so as to oppose the recording head 30, and to define the clearance between the recording sheet P and the recording head 30. A discharge mechanism, including a discharge drive roller 31 driven by a non-illustrated motor and a discharge slave roller 32 that follows the rotation of the transport drive roller 31 in contact therewith, is provided downstream of the platen 28. The recording sheet P that has undergone the recording operation by the recording head 30 is discharged by these rollers to the discharged sheet tray 8.

A configuration of the scanner unit 3 will now be described hereunder. The scanner unit 3 is pivotably connected to the recording unit 2 via a pivotal shaft 40 (FIG. 4), to open and close the top face of the recording unit 2 by being made to pivot. When the scanner unit 3 is open the internal region of the recording unit 2 can be accessed, for example to remove a jammed recording sheet.

The scanner unit 3 includes a reading unit 43 configured to move in a direction parallel to the scanning direction of the recording head 30 (left-right direction in FIG. 3 and depth direction in FIG. 4). The reading unit 43 includes an image sensor such as a contact image sensor (CIS) or a charge coupled device (CCD).

The reading unit 43 has a slender shape extending in the depth direction of the apparatus (up-down direction in FIG. 3 and left-right direction in FIG. 4), and is configured to move in the scanning direction driven by a force from a non-illustrated source, and guided by a guide rail 42 extending in the scanning direction, which is an example of the guide member in the invention. A numeral 44 of the reading unit 43 indicates an engaging portion disposed in sliding contact with the guide rail 42. A numeral 46 indicates a slave roller that freely rotates in contact with an inner bottom portion of the scanner unit 3. The parallel orientation (posture) of the reading unit 43 with respect to the source document table 39 is maintained by the engaging portion 44 and the slave roller 46.

A protruding portion 41 is formed on a bottom face 45 of the scanner unit 3, so as to protrude toward the recording unit 2 from the bottom face 45 and to extend in the scanning direction of the reading unit 43. The protruding portion 41 is provided because of the need to form the guide rail 42.

In the printer 1 according to this embodiment, as shown in FIG. 4, the head unit 29, the protruding portion 41, and the pivotal shaft 40 of the scanner unit 3 are located in this order in the depth direction of the printer 1, from the front side (on the right in FIG. 4) toward the rear side (on the left in FIG. 4). The protruding portion 41 is on the side of the pivotal shaft 40 in the depth direction of the printer 1, with respect to the center of the scanner unit 3.

Thus, since the protruding portion 41 of the scanner unit 3 and the head unit 29 are deviated from each other in the depth direction of the printer 1, there is no need to superpose the protruding portion 41 on the head unit 29. Accordingly, the head unit 29 and the protruding portion 41 can be disposed to overlap in the height direction. Such a configuration contributes to reducing the height of the apparatus, compared with the case where the protruding portion 41 is superposed on the head unit 29.

Hereunder, the ink supply system for supplying the ink to the recording head 30 will be described in details. A numeral 54 in FIGS. 1 and 2 indicates a housing constituting the appearance of the recording unit 2, and the housing 54 includes an opening 54*b* formed in the upper face thereof. A part of the stroke region of the head unit 29 is exposed through the opening 54*b*, which allows, for example, a jammed sheet to be removed through the opening 54*b* upon opening the scanner unit 3.

Ink cartridges are not mounted on the head unit 29 according to this embodiment, but instead the ink is supplied to the recording head 16 from ink tanks 48 (48A to 48F) attached to the side face of the housing 54 through a plurality of ink tubes 52 constituting the ink flow path.

More specifically, the ink tanks 48A to 48F are ink chambers respectively containing different color inks. For instance, the ink tanks 48A to 48F contain black ink, yellow ink, magenta ink, cyan ink, light cyan ink, and light magenta ink, respectively.

The plurality of ink tubes 52 are flexible tubes constituting the ink flow paths of the respective color inks between the ink tanks 48 and the recording head 16. The head unit 29 includes intermediate units 50A to 50F respectively corresponding to the color inks.

The intermediate units 50A to 50F each serve to intermediate between the recording head 16 and the ink tank 48, and the plurality of ink tube 52 are respectively connected to the intermediate units 50A to 50F. In other words, the ink tubes 52 extend from the intermediate units 50A to 50F to outside of the head unit 29.

Hereinafter, the ink tanks will be simply referred to as "ink tank 48" in the case where the ink tanks 48A to 48F do not have to be specifically distinguished, and likewise the intermediate units will be simply referred to as "intermediate unit 50" in the case where the intermediate units 50A to 50F do not have to be specifically distinguished.

The ink tubes 52 extending outward from inside of the opening 54*b* are fixed to a region along the opening 54*b* in the upper face 54*a* of the housing 54. A numeral 58 in FIG. 4 indicates a tube fastener, by which the plurality of ink tubes 52 are fixed to the upper face 54*a*, in horizontal alignment. The tube fastener 58 may be formed of any material such as a tape, a wire, or a plate-shaped material, provided that the ink tube 52 can be effectively fixed to the upper face 54*a* of the housing 54.

As described above, the ink tubes 52 are fixed to the region along the opening 54*b* in the upper face 54*a* of the housing 54 in this embodiment. Utilizing thus the region along the opening 54*b* in the upper face 54*a* of the housing 54 to fix the ink tubes 52 allows the space and the cost for arranging the ink tubes 52 to be saved.

Referring to FIG. 2, the head unit 29 illustrated with solid lines is located at the right end of the stroke range viewed from the front side of the apparatus, and the head unit 29' illustrated with broken lines is located at the left end of the stroke range. The ink tubes 52 are deformed in the section between the tube fastener 58 and the head unit 29, following the movement of the head unit 29.

The ink tubes 52 extending from the tube fastener 58 toward the ink tank 48 come out to the left side of the housing 54 through the gap 57 (see FIG. 1) between the scanner unit 3 and the recording unit 2 (housing 54), and are connected to the ink tanks 48 of the respective colors.

In this embodiment, the gap 57 is defined by a pair of bosses 56 exemplifying the gap forming member in the invention. The bosses 56 are located at the respective end portions on the upper face 54*a* of the housing 54 in the left-right direction, to be made to abut the bottom face 45 of the scanner unit 3 when the scanner unit 3 is closed thus to define the gap 57 shown in FIG. 1. Here, although a pair of bosses 56 are provided in this embodiment, just one boss or three or more bosses may be provided, as long as the gap 57 can be effectively formed.

The gap 57 serves for the ink tubes 52 to pass therethrough, and has a size that prevents the ink flow path inside the ink tubes 52 from being blocked. If the ink tubes 52 collapse between the scanner unit 3 and the recording unit 2, the ink flow path is blocked and the ink is disabled from flowing further toward the recording head 30. For such a reason the gap 57 is defined in a size that prevents the ink flow path inside the ink tubes 52 from being blocked.

It is not mandatory that the size of the gap 57 is larger than the outer diameter of the ink tube 52. The ink tube 52 may be partially flattened by the gap 57 between the scanner unit 3 and the recording unit 2, provided that the ink flow path inside the ink tubes 52 is exempted from being blocked. Alternatively, the scanner unit 3 may be supported by the rigidity of the ink tubes 52 themselves, instead of forming the gap 57 with the boss 56. In this case, the ink tube 52 may be partially flattened between the scanner unit 3 and the recording unit 2, as long as the ink flow path inside the ink tubes 52 is exempted from being blocked.

Further, on the upper portion of the recording unit 2 a bore 54*c* is provided in the upper face 54*a* of the housing 54, as shown in FIG. 2, and a switch 60 is provided inside the bore 54*c*. In this embodiment, the switch 60 serves as a detector for detecting whether the scanner unit 3 is closed.

To be more detailed, the scanner unit 3 includes a projection 47 (see FIG. 5) formed on the bottom face 45. When the scanner unit 3 is closed, the projection 47 intrudes in the bore 54*c* as the transition illustrated in FIGS. 6A and 6B, and presses down a lever 61 of the switch (hereinafter, this action will simply be referred to as "press down the switch 60"). At this moment, a control unit 63 (see FIGS. 6A and 6B) to which the switch 60 is connected detects that the scanner unit 3 has been closed. The control unit 63 serves to control the functions of the printer 1 as a whole, including the head unit 29, the recording head 30, the rollers shown in FIG. 2, and so forth.

In this embodiment, the control unit 63 inhibits the recording operation when the switch 60 is detected to be unpressed, i.e., when the scanner unit 3 is open. In contrast, the control unit 63 permits the recording operation when the switch 60 is detected to be held down, i.e., when the scanner unit 3 is closed.

Figure 6A:
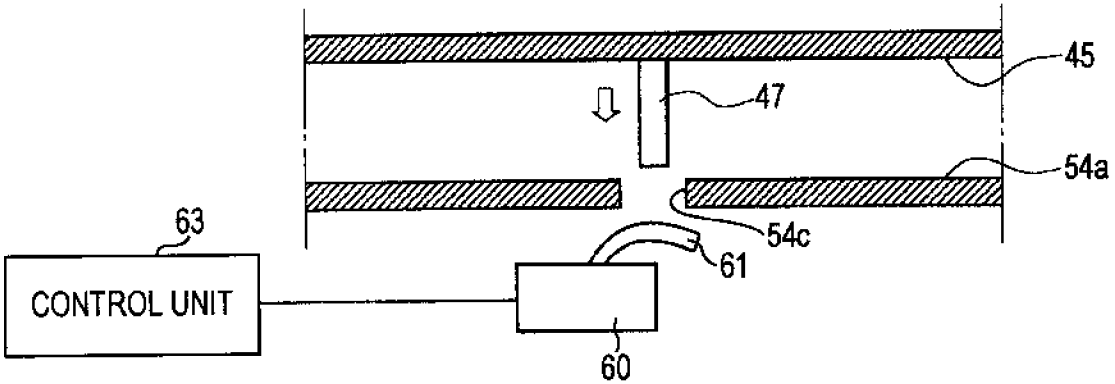
FIGS. 6A and 6B are front views of a switch provided on a top portion of a recording unit.
Figure 6B:
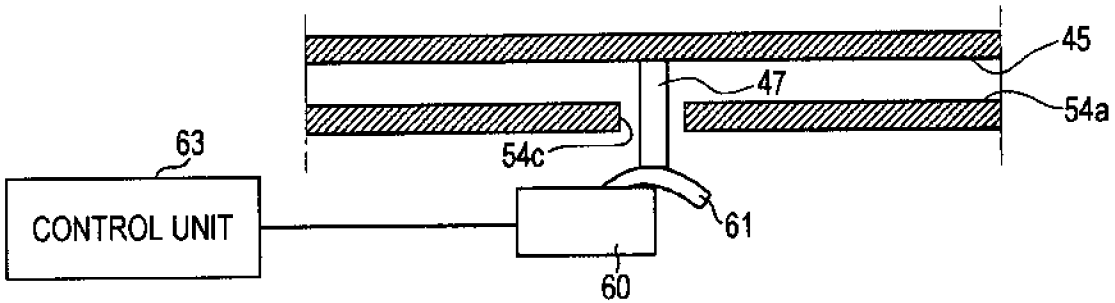

FIG. 6B illustrates the state where the gap 57 is defined by the boss 56 formed on the upper face 54*a* of the housing 54. In this state, as shown in FIG. 6B, the projection 47 formed on the bottom face 45 of the scanner unit 3 intrudes in the bore 54*c* and presses down the switch 60. Thus, the printer 1 is configured such that the switch 60 is pressed down with the gap 57 defined between the recording unit 2 and the scanner unit 3 for the ink tubes 52 to pass therethrough, the gap 57 having a size that exempts the ink flow path inside the ink tubes 52 from being blocked. Accordingly, the projection 47 has a length that reaches the switch 60 when the scanner unit 3 is closed with the gap 57.

Therefore, the recording operation can be performed with the gap 57 defined between the recording unit 2 and the scanner unit 3 for the ink tubes 52 to pass therethrough, in other words with the gap of a minimum necessary size. Such a configuration suppresses an increase in height of the printer 1 despite the ink tubes 52 being passed through between the recording unit 2 and the scanner unit 3, without compromising the recording performance.

Figure 7A:
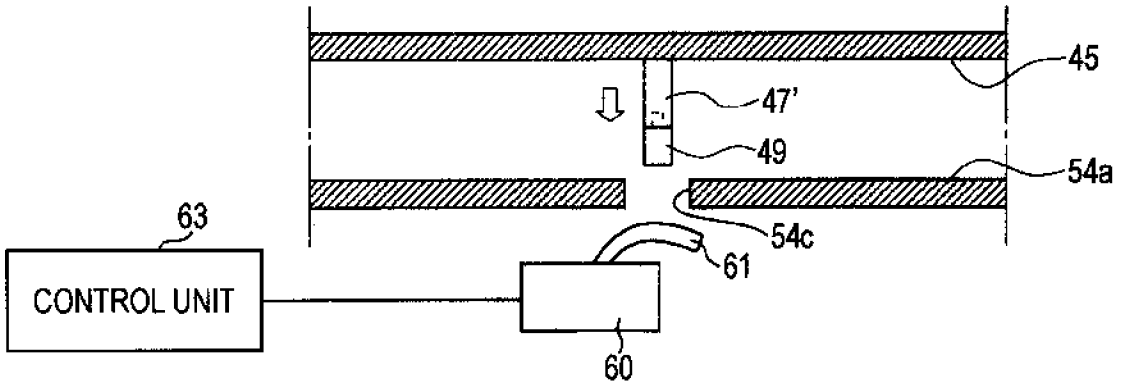
FIGS. 7A and 7B are front views of a different switch provided on the top portion of the recording unit.
Figure 7B:
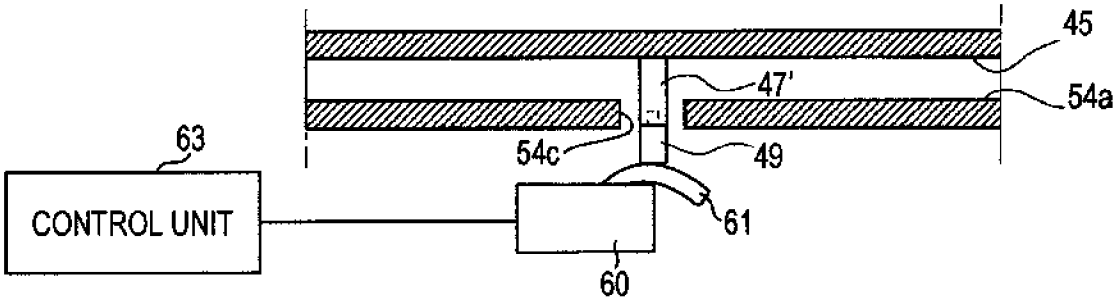

Here, instead of forming the projection 47 in a length that reaches the switch 60 (despite the gap 57 being formed) when the scanner unit 3 is closed, an extension piece 49 may be attached to the tip portion of the projection 47' as shown in FIGS. 7A and 7B, so as to press down the switch 60 when the scanner unit 3 is closed.

Irrespective of which configuration is adopted between FIG. 6B and FIG. 7B, the gap 57 may be defined by bringing the projection formed on the scanner unit 3 into contact with the witch 60. In other words, the projection may be made to serve as the gap forming member that defines the gap 57.

Further, instead of adopting the projection for pressing down the switch 60 when the scanner unit 3 is closed with the gap 57, for example a pressing piece may be inserted in the bore 54*c* so as to press down the switch 60, and then the bore 54*c* may be covered with a tape or the like.

As described above, in this embodiment the head unit 29, the protruding portion 41 of the scanner unit 3, and the pivotal shaft 40 of the scanner unit 3 are located in this order in the depth direction of the printer 1, from the front side (on the right in FIG. 4) toward the rear side (on the left in FIG. 4). With such a configuration, the ink tubes 52 are connected to both of the head unit 29 and the ink tank 48, without intersecting the protruding portion 41. Therefore, there is no need to secure a space under the protruding portion 41 for the ink tubes 52 to pass therethrough, which contributes to suppressing an increase in size of the apparatus in the height direction.

In this embodiment, further, the discharged sheet tray 8 is also configured so as to suppress an increase in size of the apparatus in the height direction. The discharged sheet tray 8 will now be described in details hereunder.

Referring to FIG. 9, the discharged sheet tray 8 includes a sheet receiving surface 8*a* for receiving the recording sheet P, and the entire region of the sheet receiving surface 8*a* is formed of a single member in this embodiment. Accordingly, the discharged sheet tray 8 is not a multi-level tray (drawer type), but a single-level tray. To be more detailed, the entirety of the discharged sheet tray 8 is integrally formed of a resin material. Therefore, a sufficient rigidity is given to the discharged sheet tray 8, and the simplified structure contributes to reducing the cost.

The respective side edges 8*e* of the discharged sheet tray 8 in the direction intersecting the sheet discharge direction, i.e., in the width direction of the sheet, is supported by a frame (not shown) constituting the case structure of the apparatus main body 2, so as to slide along the frame. The discharged sheet tray 8 includes a pair of rack gears 8*f* formed along the respective end portions in the direction intersecting the sheet discharge direction, so as to extend in the sheet discharge direction. Accordingly, when a pair of pinion gears (not shown), driven by a non-illustrated motor, are engaged with the respective rack gears 8*f*, the discharged sheet tray 8 is displaced (made to slide).

The discharged sheet tray 8 includes a pair of elevated portions 8*d* formed on the downstream side of the respective end portions of the sheet receiving surface 8*a* in the sheet width direction, so that the respective end portions of the recording sheet P in the width direction climb on the elevated portions 8*d*. The recording sheet P of such a size that the end portions in the width direction climb on the elevated portions 8*d* can be prevented from falling from the discharged sheet tray 8, because the leading edge of the sheet is oriented upward. In addition, when the end portions of the sheet in the width direction climb on the elevated portions 8*d*, the sheet is curled. Therefore, the leading edge of the sheet is prevented from hanging downward from the downstream end of the discharged sheet tray 8 although the leading edge of the sheet protrudes from the discharged sheet tray 8, and thus prevented from falling. Here, a guide slope 8*b* is provided upstream of the elevated portion 8*d*, so that the leading edge of the sheet can smoothly climb on the elevated portions 8*d*, without being caught by the elevated portions 8*d*.

On the other hand, in the case of a sheet that is not so wide that the side edges in the width direction climb on the elevated portion 8*d*, the leading edge of the sheet rarely protrudes from the downstream end of the discharged sheet tray 8, and hence the sheet is scarcely likely to fall from the discharged sheet tray 8. In addition, the guide slope 8*b* is provided on the downstream end portion of the central region of the sheet receiving surface 8*a* (between the pair of elevated portions 8*d*), and is connected to an upper surface 8*j* elevated from the sheet receiving surface 8*a*. Therefore, the sheet not so wide that the side edges climb on the elevated portion 8*d* can be further prevented from falling from the discharged sheet tray 8, by the guide slope 8*b* and the upper surface 8*j*.

The elevated portion 8*d* includes a tray guide surface 8*h* that supports and guides a disk tray (not shown). The disk tray is utilized for setting an optical disk (not shown) thereon. This is because the printer 1 according to this embodiment is capable of performing the recording operation on the label surface of an optical disk. The tray guide surface 8*h* is located slightly higher than the upper surface 8*j*, and at a level that allows the disk tray to be horizontally inserted toward the transport route in the apparatus main body 2.

An eaves portion 8*k* is provided above the tray guide surface 8*h*. The eaves portion 8*k* serves to regulate the posture of the disk tray so as to prevent the side edges of the disk tray from being largely lifted from the tray guide surface 8*h*. Further, a tray support projection 8*g* is provided at a slightly inner position from the tray guide surface 8*h*. After the disk tray is introduced in the transport route, the disk tray is supported by the discharge drive roller 31 and the tray support projection 8*g* so as to maintain the horizontal orientation.

The discharged sheet tray 8 includes a cutout 8*r* formed in the upstream portion in the sheet discharge direction (left upper portion in FIGS. 9 and 10), to avoid interference with the feed unit 9. The feed unit 9 includes the feed roller 10, the swinging member 11, and a series of gears 14 for transmitting the driving force from the pivotal shaft 12 to the feed roller 10.

The cutout 8*r* formed in the discharged sheet tray 8 is a cutout having a width h (in the width direction of the sheet) that is slightly wider than the width of the swinging member 11. Accordingly, the cutout 8*r* is disposed to surround the feed unit 9 when the discharged sheet tray 8 is at the retracted position (FIG. 9), so as to allow the swinging member 11 to swing inside the cutout 8*r*. In addition, the reference feed position is set at the center of the sheet in the width direction in this embodiment, and hence the cutout portion 8*r* is formed at a substantially central portion of the discharged sheet tray 8 in the sheet width direction.

The cutout 8*r* provides the following advantageous effects. Since the discharged sheet tray 8 is accommodated inside the apparatus main body 2, locating the feed unit 9 so as to be superposed on the discharged sheet tray 8 when the discharged sheet tray 8 is retracted into the apparatus main body 2 leads to an increase in size of the apparatus, especially the size in the height direction.

However, as described above, the discharged sheet tray 8 includes the cutout 8*r* for avoiding interference with the feed unit 9. Such a configuration eliminates the need to superpose the feed unit 9 on the discharged sheet tray 8 in the height direction and allows the feed unit 9 and the discharged sheet tray 8 to overlap in the height direction, thereby contributing to reducing the size of the apparatus in the height direction.

Further, as stated earlier, the discharged sheet tray 8 includes the pair of elevated portions 8*d* formed on the downstream side of the sheet receiving surface 8*a*, so that the respective end portions of the sheet (in the width direction) climb on the elevated portion 8*d*. When the end portions of the sheet climb on the elevated portion 8*d*, the sheet becomes curled. In FIG. 10, the curled sheet is denoted as P' and illustrated with imaginary lines. The sheet becomes thus curled when the end portions of the sheet in the width direction on the downstream side climb on the elevated portion 8*d*, and in addition the central portion of the sheet on the upstream side slightly sinks into the cutout 8*r*.

Therefore, the leading edge of the sheet is prevented from hanging downward from the downstream end of the discharged sheet tray 8 although the leading edge of the sheet protrudes from the discharged sheet tray 8, and thus prevented from falling. Although it is preferable that the escape portion 8*r* is formed in the central portion of the discharged sheet tray 8 in the sheet width direction in order to curl the sheet as shown in FIG. 10, the sheet can be urged to be curled provided that the elevated portions 8*d* are formed on the respective end portions of the discharged sheet tray 8 in the width direction on the downstream side, despite the cutout 8*r* being shifted from the central portion of the discharged sheet tray 8 in the sheet width direction.

In this embodiment, the bottom portion 8*s* of the escape portion 8*r* is generally flat in a plan view as shown in FIG. 11A. Alternatively, the bottom portion may be formed in a V-shape or U-shape such that the escape portion becomes narrower toward the downstream side in the sheet discharge direction, as a bottom portion 8*s*' of an escape portion 8*r*' shown in FIG. 11B.

Variations

It is a matter of course that the foregoing embodiment is merely exemplary and that the invention is in no way limited to the embodiment. For example, the following variations should be construed to be within the scope of the invention.

The plurality of ink tubes 52 may be bundled at desired positions with a strap or the like.

Although the tube fastener 58 is provided on the front side of the apparatus with respect to the opening 54*b* in the embodiment, the tube fastener may be located on the rear side or lateral side of the apparatus with respect to the opening 54*b*.

In the foregoing embodiment, all the ink tanks 48 are located on the left side of the apparatus and the ink tubes 52 are arranged from the left side. Instead, the ink tanks 48 may be located on the right side of the apparatus and the ink tubes 52 may be arranged from the right side. Alternatively, as shown in FIG. 8, some of the ink tanks 48 may be located on the right side of the apparatus and the others on the left side, and the ink tubes 52 may be dividedly arranged from the respective sides.

The ink tank 48 may be provided as a device independent from the housing 54, and located away from the housing 54.

The plurality of ink tanks 48 may be located inside the apparatus main body 2. Alternatively, one or more ink tanks of (a) specific color(s) may be located inside the apparatus main body 2.

The ink tank 48 may be of a refillable type that can be refilled with the ink, or may be provided with a replaceable pack containing the ink.

The upper structure that opens and closes the top portion of the recording unit 2, which is exemplified by the scanner unit 3 in the foregoing embodiment, may simply be a cover, or may be another functional unit than the scanner.

Although six pieces of ink tanks 48 are provided in the embodiment, just a single piece of ink tank, for example containing black ink, may be provided and accordingly a single piece of ink tube 52 may be provided for the black ink.

Although the invention is applied to the ink jet printer in the embodiment, the invention is broadly applicable to different types of liquid ejecting apparatuses.

Here, the liquid ejecting apparatuses include, in addition to printers having an ink jet recording head and configured to eject ink from the recording head onto a recording medium, and recording apparatuses such as copiers and facsimile machines, all such apparatuses that eject a predetermined liquid instead of ink from a liquid ejecting head corresponding to the ink jet recording head, onto a target medium corresponding to the recording medium thereby depositing the liquid onto the target medium.

Further, examples of the liquid ejecting head include, other than the foregoing recording head, those that eject a color material for manufacturing color filters for LCDs, an electrode material (conductive paste) for forming electrodes of organic EL displays and field emission displays (FED), a bioorganic substance for manufacturing biochips, and those employed as a precision pipette that ejects a specimen.

The entire disclosure of Japanese Patent Application No. 2012-178505, filed Aug. 10, 2012 is expressly incorporated by reference herein.

What is claimed is:

1. A recording apparatus comprising:

a recording unit including a head unit having a recording head that ejects ink onto a medium, the head unit being mounted inside a main body of the apparatus so as to move in a scanning direction of the recording head; and an upper structure provided on top of the recording unit so as to open and close the top portion of the recording unit, the recording unit further including:

a flexible ink tube through which the ink from an ink chamber is supplied to the head unit;

a control unit that controls the head unit, according to a state of a press-down switch provided on the top portion of the recording unit, so as to perform recording on the medium when a pressed state of the switch is detected and not to perform the recording when an unpressed state of the switch is detected;

a feed unit that delivers the medium from a medium storage unit in which the medium is stored; and a medium receiving tray that receives the medium discharged and that can be displaced between a projecting position in which the medium receiving tray sticks out from the recording unit and a retracted position in which the medium receiving tray is accommodated inside the recording unit, wherein the medium storage unit includes a medium storage tray located under the medium receiving tray and configured to be removably mounted in the recording unit independent from the medium receiving tray, the medium receiving tray includes a cutout formed on an upstream side in a discharge direction of the medium so as to avoid interference with the feed unit so that the feed unit is located inside the cutout when the medium receiving tray is at the retracted position, and the switch enters the pressed state when a gap that allows the ink tube to pass therethrough is formed between the recording unit and the upper structure, the gap having a size that at least prevents an ink flow path in the ink tube from being blocked.

2. The recording apparatus according to claim 1, wherein the feed unit and the cutout overlap in a height direction when the medium receiving tray is at the retracted position.

3. The recording apparatus according to claim 2, wherein a reference feed position of the feed unit is located at a position corresponding to the center of the medium in a width direction, and the cutout is located at a central position of the medium receiving tray in the width direction of the medium.

4. The recording apparatus according to claim 3, wherein the cutout is formed so as to become narrower toward a downstream side in a direction in which the medium is discharged.

5. The recording apparatus according to claim 4, wherein the medium receiving tray includes a guide portion that supports a disk tray.

6. The recording apparatus according to claim 2, wherein the medium storage unit includes a plurality of the medium storage trays including a lower tray and an upper tray located above the lower tray independent therefrom, and the feed unit can make access to one of the upper tray and the lower tray when the other is removed from the recording unit.

7. The recording apparatus according to claim 6, wherein the feed unit includes a single feed roller, and the single feed roller can make access to both the upper tray and the lower tray.

8. The recording apparatus according to claim 2, wherein the upper structure is a scanner unit.

9. The recording apparatus according to claim 8, wherein the scanner unit includes a protruding portion bulging from a bottom face of the scanner unit and including a guide member configured to guide in the scanning direction a reading unit that makes a scanning motion in the stroke direction of the head unit, and the ink tube is connected to both the head unit and the ink chamber without intersecting the protruding portion in a depth direction of the recording unit.

10. The recording apparatus according to claim 2, wherein the gap is defined by a gap forming member provided on an upper face of the recording unit.

11. The recording apparatus according to claim 2, wherein the recording unit includes a housing having an opening in which an upper portion of at least a part of a stroke region of the head unit is exposed, and the ink tube is fixed to an upper face of the housing at a position close to the opening.

12. The recording apparatus according to claim 2, wherein the switch is located in a bore formed in the upper face of the recording unit, and the upper structure includes a projection formed on a lower face so as to press down the switch upon intruding in the bore and form the gap while keeping the switch pressed.

13. The recording apparatus according to claim 2, wherein at least one of a plurality of the ink chamber is located outside the apparatus main body.

14. The recording apparatus according to claim 13, wherein the ink chamber provided outside the apparatus main body is located on a side face of the recording unit.

15. A recording apparatus comprising:

a recording unit including a head unit having a recording head that ejects ink onto a medium, the head unit being configured to move in a scanning direction of the recording head; and a scanner unit provided on top of the recording unit so as to open and close the top portion of the recording unit, the recording unit further including:

a flexible ink tube through which the ink from an ink chamber is supplied to the head unit; and a control unit that controls the head unit, according to a state of a press-down switch provided on the top portion of the recording unit, so as to perform recording on the medium when a pressed state of the switch is detected and not to perform the recording when an unpressed state of the switch is detected, wherein the switch enters the pressed state when a gap that allows the ink tube to pass therethrough is formed between the recording unit and the scanner unit, the gap having a size that at least prevents an ink flow path in the ink tube from being blocked.

16. A recording apparatus comprising:

a recording unit including a head unit, a flexible ink tube through which an ink from an ink chamber is supplied to the head unit;

an open and close member provided on a top of the recording unit so as to open and close a top portion of the recording unit;

a sensor for detecting the open or closed state of the open and close member provided in the recording unit; and a control unit which performs recording on the medium by controlling the head unit when the sensor detects the closed state, and which does not perform recording when the sensor detects the opened state, wherein the ink tube passes through between the recording unit and the open and close member, wherein when the open and close member is detected in the closed state, the open and close member does not block the ink flow path of the ink tube.

17. The recording apparatus according to claim 16, wherein a housing accommodates the recording unit, at least a portion of the ink chamber is disposed on the outside of the housing, a hole portion which detects the open or closed state of the open and close member is formed in the housing, and when the open and close member is detected in the closed state with a shut member which shuts the hole portion, the open and close member does not block the ink flow path of the ink tube.

18. The recording apparatus according to claim 17, wherein the hole portion is disposed at a sheet discharge side and an upper face of the recording unit, and the ink tube disposed at the upper face of the recording unit.

19. The recording apparatus according to claim 18, wherein a fixed member fixes the ink tube to at least a portion of the upper face of the recording unit.

20. The recording apparatus according to claim 18, wherein a gap is defined by a gap forming member provided on the upper face of the recording unit.

21. The recording apparatus according to claim 16, wherein a housing accommodates the recording unit, at least a portion of the ink chamber is disposed on the outside of the housing, and a hole portion which detects the open or closed state of the open and close member is formed in the housing, the sensor includes a switch capable of pressing down, and detecting a depressed state of the switch when an insertion member is inserted in the inside of the hole portion, the switch is provided in the inside of the hole portion, wherein detecting the depressed state of the switch when an insertion member is inserted in the inside of the hole portion when the open and close member is detected in the closed state, the open and close member does not block the ink flow path of the ink tubes.

22. The recording apparatus according to claim 21, wherein the hole portion is disposed at a sheet discharge side and an upper face of the recording unit, and the ink tube disposed at the upper face of the recording unit.

23. The recording apparatus according to claim 22, wherein a fixed member fixes the ink tube to at least a portion of the upper face of the recording unit.

24. The recording apparatus according to claim 22, wherein a gap is defined by a gap forming member provided on the upper face of the recording unit.

25. The recording apparatus according to claim 16, further comprising:

a feed unit that delivers the medium from a medium storage unit in which the medium is stored; and a medium receiving tray that receives the medium discharged and that can be displaced between a projecting position in which the medium receiving tray sticks out from the recording unit and a retracted position in which the medium receiving tray is accommodated inside the recording unit, wherein the medium storage unit includes a medium storage tray located under the medium receiving tray and configured to be removably mounted in the recording unit independent from the medium receiving tray, the medium receiving tray includes a cutout formed on an upstream side in a discharge direction of the medium so as to avoid interference with the feed unit so that the feed unit is located inside the cutout when the medium receiving tray is at the retracted position.

26. The recording apparatus according to claim 25, wherein the feed unit and the cutout overlap in a height direction when the medium receiving tray is at the retracted position.

27. A method for detecting an open and closed state in a recording apparatus that includes a recording unit having a head unit, a flexible ink tube through which an ink from an ink chamber is supplied to the head unit, an open and close member provided on a top of the recording unit so as to open and close the top portion of the recording unit, a sensor for detecting the open or closed state of the open and close member provided in the recording unit, a control unit which performs recording on the medium by controlling the head unit when the sensor detects the closed state, and which does not perform recording when the sensor detects the opened state, the method comprising:

detecting the closed state, wherein the ink tube passes through between the recording unit and the open and close member, wherein when the open and close member is detected in the closed state, the open and close member does not block the ink flow path of the ink tube.

28. The method of claim 27, wherein the recording apparatus includes a housing which accommodates the recording unit, at least a portion of the ink chamber is disposed on the outside of the housing, and a hole portion which detects the open or closed state of the open and close member is formed in the housing, the method comprising detecting the open and close member in, wherein when the open and close member is detected in the closed state with a shut member which shuts the hole portion, the open and close member does not block the ink flow path of the ink tube.

29. The method of claim 27, wherein the recording apparatus includes a housing which accommodates the recording unit, at least a portion of the ink chamber is disposed on the outside of the housing, a hole portion which detects the open or closed state of the open and close member is formed in the housing, the sensor includes a switch capable of pressing down, and the switch is provided in the inside of the hole portion, the method comprising detecting the depressed state of the switch when an insertion member is inserted in the inside of the hole portion, wherein the open and close member is detected in the closed state when the insertion member is inserted in the inside of the hole portion and the open and close member does not block the ink flow path of the ink tube.

30. A method for manufacturing a recording apparatus that includes a recording unit having a head unit, a flexible ink tube through which an ink from an ink chamber is supplied to the head unit, an open and close member provide on top of the recording unit so as to open and close the top portion of the recording unit, a sensor for detecting the open or closed state of the open and close member provided in the recording unit, a control unit which performs recording on the medium by controlling the head unit when the sensor detects the closed state, and which does not perform recording when it detects the opened state, the method comprising:

detecting the closed state, wherein the ink tube passes through between the recording unit and the open and close member, wherein when the open and close member is detected in the closed state, the open and close member does not block the ink flow path of the ink tube.

31. The method of claim 30, wherein the recording apparatus includes a housing which accommodates the recording unit, at least a portion of the ink chamber is disposed on the outside of the housing, and a hole portion which detects the open or closed state of the open and close member and is formed in the housing, the method comprising when the open and close member is detected the closed state with a shut member which shuts the hole portion, it does not block the ink flow path of the ink tube.

32. The method of claim 30, wherein the recording apparatus includes a housing which accommodates the recording unit, at least a portion of the ink chamber is disposed on the outside of the housing, a hole portion which detects the open or closed state of the open and close member and is formed in the housing, the sensor is composed of a switch capable of pressing down, the switch is provided in the inside of the hole portion, the method comprising detecting the depressed state of the switch when an insertion is inserted in the inside of the hole portion, wherein when the open and close member is detected in the closed state, the open and close member does not block the ink flow path of the ink tube.

33. The method of claim 32, wherein the hole portion is disposed at the sheet discharge side and an upper face of the recording unit, the method comprising disposing the ink tube at the upper face of the recording unit.

34. The method of claim 32, further comprising fixing the ink tube to at least a portion of the upper face of the recording unit with a fixed member.

35. The method of claim 32, further comprising defining gap by a gap forming member provided on the upper face of the recording unit.

* * * * *